United States Patent [19]

Belthle

[11] Patent Number: 4,630,403

[45] Date of Patent: Dec. 23, 1986

[54] METHOD AND MACHINE FOR GRINDING ROTATIONALLY SYMMETRICAL WORKPIECES

[75] Inventor: Heinz Belthle, Aichwald, Fed. Rep. of Germany

[73] Assignee: Schaudt Maschinenbau GmbH, Stuttgart, Fed. Rep. of Germany

[21] Appl. No.: 783,193

[22] Filed: Oct. 2, 1985

[30] Foreign Application Priority Data

Oct. 11, 1984 [DE] Fed. Rep. of Germany ..... 3437322

[51] Int. Cl.[4] ..... B24B 11/00

[52] U.S. Cl. ..... 51/105 VG; 51/237 T; 51/108 R

[58] Field of Search ..... 51/105 SP, 105 VG, 105 R, 51/108 R, 237 R, 237 T, 216 ND, 165.71, 165.76, 216 A, 217 A, 125.5, 27, 241 VS

[56] References Cited

U.S. PATENT DOCUMENTS 2,136,188 12/1938 Gagne et al. ..... 51/105 VG
4,517,770 5/1985 Leibowitz ..... 51/125.5

FOREIGN PATENT DOCUMENTS 2488541 2/1982 France ..... 51/105 VG

*Primary Examiner*—Harold D. Whitehead
*Assistant Examiner*—Maurina Rachuba
*Attorney, Agent, or Firm*—Peter K. Kontler

[57] ABSTRACT

Poppets of lift valves are ground in a grinding machine wherein the chuck clamps the stem midway between the head and the foot of the poppet and is indexible through 180° so as to place the foot into the range of a first portion of the working surface of a grinding wheel in one of its positions and to place the head into the range of another portion of the working surface of the same grinding wheel in the other of its positions. The entire working surface of the grinding wheel is dressed during grinding of the head, and the carriage for the spindle of the grinding wheel is moved in response to signals which denote the final position of the grinding wheel upon completed grinding of the foot. The chuck is indexible in a rotary work holder whose axis coincides with the axis of the clamped poppet and is normal to the axis about which the chuck is indexed by a rack-and-pinion drive.

8 Claims, 4 Drawing Figures

METHOD AND MACHINE FOR GRINDING ROTATIONALLY SYMMETRICAL WORKPIECES

BACKGROUND OF THE INVENTION

The invention relates to a method and to a machine for removing material from axially spaced-apart portions of rotary workpieces which are symmetrical with reference to their axes of rotation. Typical examples of such workpieces are valving elements of lift valves, e.g., simple poppet valves of the type used in the engines of motor vehicles, wherein one end of the stem constitutes a foot and the other end of the stem carries a mushroom-shaped or otherwise configurated enlarged portion or head with a normally frustoconical circumferentially extending sealing surface which can engage the seat in the body of the valve wherein the valving element is put to use.

The treatment of workpieces of the above outlined character necessitates removal of material with utmost precision so as to ensure that the sealing surface of the head will be located at a predetermined distance from certain portions of the foot, e.g., from the end face of the foot and/or from a groove in the peripheral surface of the foot. Such high-precision treatment cannot be ensured in conventional grinding and like material removing machines wherein a workpiece is repeatedly clamped, first to allow for treatment of one of its end portions and thereupon to allow for removal of material from the other end portion. Valving elements which are used in many types of lift valves and analogous valves must be machined with tolerances which constitute minimal departures from optimum dimensions. Thus, if the valving element is a poppet with a head at one end and an externally grooved foot at the other end of the stem, the distance between the flat end face of the head and the groove, the distance between the central portion of the sealing surface on the head and the groove and/or the distance between the central portion of the sealing surface on the head and the end face of the foot must match, or can deviate only negligibly from, a preselected value which ensures most satisfactory operation of the valve. One of the main reasons for the failure of conventional grinding machines and grinding methods to ensure the removal of material from the head and from the foot with the presently expected and required degree of accuracy is the need for repeated clamping and unclamping of a workpiece prior to completion of material removal at both ends of the stem.

OBJECTS AND SUMMARY OF THE INVENTION

An object of the invention is to provide a method of removing material from axially spaced-apart portions of rotary workpieces which are symmetrical with reference to their axes of rotation in such a way that the dimensions of the finished portions match or come much closer to optimum dimensions than the dimensions of finished portions which are treated in accordance with heretofore known methods.

Another object of the invention is to provide a relatively simple method which renders it possible to complete the treatment of the above outlined types of workpieces within short intervals of time and which can be resorted to for the treatment of a wide variety of workpieces.

A further object of the invention is to provide a novel and improved grinding machine which can be utilized for the practice of the above outlined method.

An additional object of the invention is to provide a grinding machine wherein the workpieces are treated, oriented and otherwise manipulated in a novel and improved way.

Still another object of the invention is to provide a grinding machine which can be used with particular advantage for the treatment of poppets and similar valving elements.

An additional object of the invention is to provide a novel and improved holder for chucks which can be used in the above outlined grinding machine.

Another object of the invention is to provide novel and improved means for regulating the operation of the above outlined grinding machine.

One feature of the invention resides in the provision of a method of removing material from axially spaced-apart first and second portions (particularly first and second end portions) of rotary workpieces which are symmetrical with reference to their axes of rotation. Examples of such workpieces are the reciprocatory valving elements of lift valves. The method comprises the steps of clamping a third portion of a workpiece (preferably a third portion which is located intermediate and most preferably at least substantially midway between the first and second portions), maintaining the thus clamped workpiece in a first predetermined position, grinding the first portion of the clamped workpiece in the first position, monitoring the dimensions of the ground first portion of the workpiece and generating and memorizing (storing) signals denoting the monitored dimensions of the first portion, inverting the workpiece and maintaining the inverted workpiece in a second predetermined position without interrupting the clamping step (i.e., the means for clamping the third portion of the workpiece continues to clamp the third portion in the course of and upon completion of the inverting step), and grinding the second portion of the inverted workpiece including effecting a relative movement of the inverted workpiece and the grinding tool (e.g., by moving the carriage for the spindle of a grinding wheel) as a function of memorized signals (this can ensure that the distance between one or more selected parts of the first portion and one or more selected parts of the second portion of the finished workpiece will match or very closely approximate the desired or optimum value).

The inverting step preferably comprises turning or indexing the workpiece through 180 degrees about an axis which is normal to and preferably intersects the axis of rotation of the workpiece.

If the first portion of the valving element constitutes that end portion or foot of the stem of a poppet which is remote from the normally mushroom-shaped head at the other end of the poppet (i.e., if the head is the enlarged other end portion of the stem), the first grinding step preferably includes removing material from the foot with a grinding wheel whose axis of rotation is askew to the axis of rotation of the workpiece, and the second grinding step preferably comprises grinding the head of the workpiece with the same grinding tool, e.g., with a portion of the working surface of that grinding tool which is used to remove material from the foot.

Such method preferably further includes the step of dressing the entire working surface of the grinding tool which removes material from the head in the course of the entire second grinding step.

Another feature of the invention resides in the provision of a grinding machine which can be utilized for the practice of the above outlined method and comprises a work holder, means for rotating the work holder about a first axis, a chuck having means (e.g., one or more diaphragms) for clamping the third portion of a workpiece, means for supporting the chuck for angular movement about a second axis which is inclined with reference to the first axis (such supporting means can constitute a portion of the holder), and means for inverting the chuck and the workpiece therein with reference to the holder. The inverting means can include a rack-and-pinion drive or other suitable means for turning or indexing the chuck about the second axis. The second axis is preferably normal to and preferably intersects the first axis, and the turning means is preferably designed to index the chuck through 180 degrees.

As mentioned above, the third portion of the workpiece which is clamped by the chuck is preferably located, and most preferably at least substantially midway, between first and second portions, as considered in the axial direction of the workpiece. The axis of the clamped workpiece coincides with the first axis when the workpiece is in the process of being treated at the one or the other of its ends.

The grinding machine further comprises a rotary spindle and a grinding wheel on the spindle. The working surface of the grinding wheel preferably includes a first circumferentially extending portion or section which is used to remove material from the first portion of a workpiece in a first position of the chuck (prior to indexing), and a second circumferentially extending portion or section which removes material from the second portion of the workpiece upon completion of the inverting step. Thus, the chuck is indexible between a first position in which the grinding wheel removes material from the first portion of a workpiece and a second position in which the same grinding wheel can remove material from the second portion of the same workpiece.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
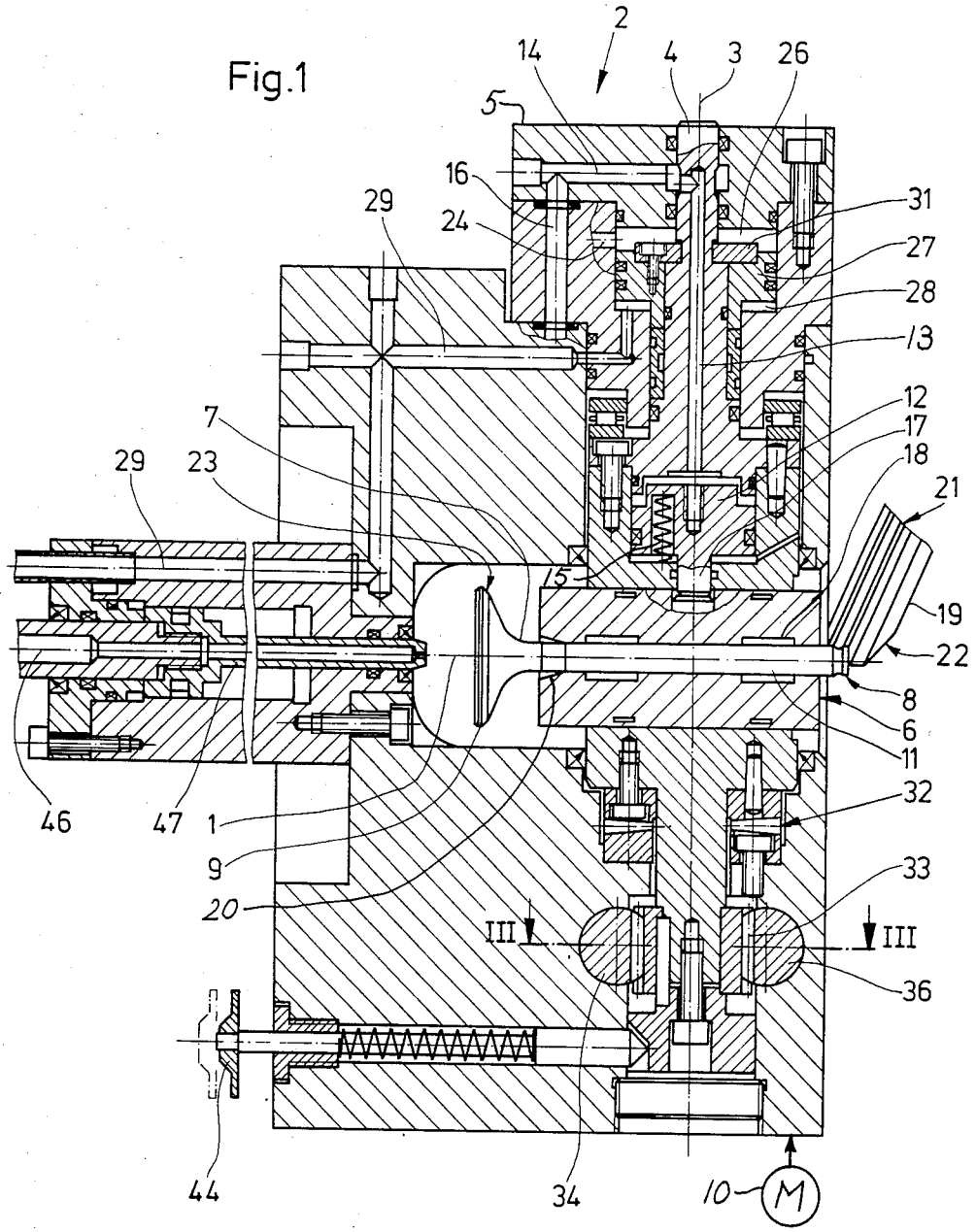
FIG. 1 is a sectional view of a portion of a machine for grinding the poppets of lift valves which embodies one form of the invention.
Figure 2:
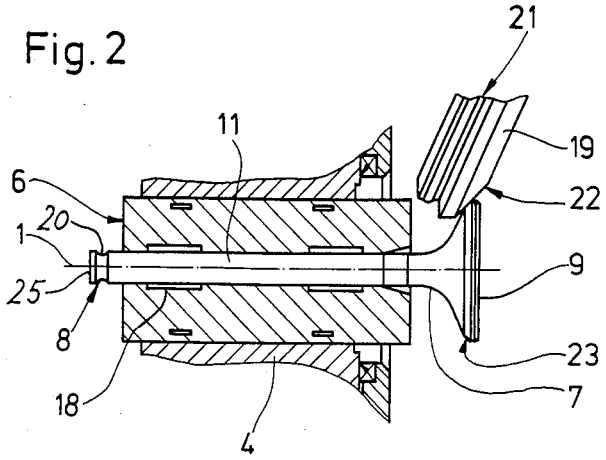
FIG. 2 shows a portion of the structure of FIG. 1 but with the chuck turned through 180 degrees with reference to the work holder.
Figure 3:
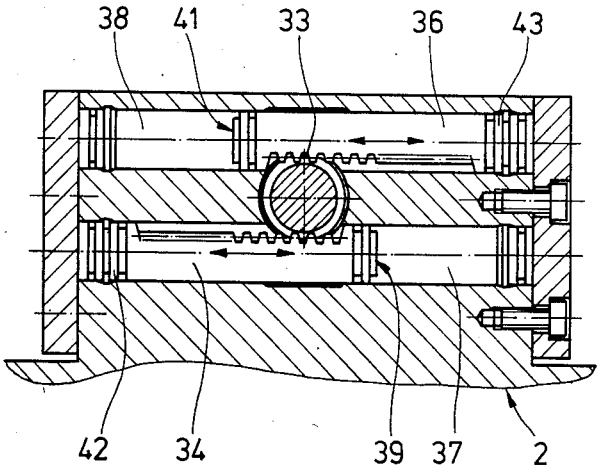
FIG. 3 is a fragmentary sectional view as seen in the direction of arrows from the line III—III of FIG. 1.

The grinding machine which includes the structure of FIGS. 1 and 3 comprises a work holder 2 rotatable about a first axis 1 which is denoted by a phantom line and which may but need not be horizontal. The work holder 2 comprises a first portion 5 which is driven by a suitable motor 10 through the medium of a toothed belt transmission or the like and supports a second portion 4 which is turnable with reference to the portion 5 about a second axis 3 that intersects and is normal to the axis 1. The portion 4 normally shares the angular movements of the portion 5 about the axis 1 but the portion 4 is also rotatable or indexible relative to the portion 5 about the axis 3 between a first position which is shown in FIG. 1 and a second position which is shown in FIG. 2. This involves an inversion of the portion 4, i.e., an angular movement through 180 degrees.

The portion 4 of the holder 2 removably supports a hydraulically operated clamping chuck 6, e.g., a chuck of the type manufactured and sold by Main-Tauber-Machinenbau GmbH, Wertheim/Main, German Federal Republic.

The workpiece 7 which is releasably held by the chuck 6 intermediate its longitudinal ends is a reciprocable valving element, e.g., the poppet of a simple lift valve having a first portion or foot 8 constituting that part of the valve stem 11 which is remote from the enlarged second portion or head 9. That portion (valve face) of the surface of the head 9 which is to engage a seat in the body of the lift valve when the element 7 is put to use is denoted by the reference character 23. The chuck 6 engages and clamps a third portion (the median portion of the stem 11) of the valving element 7 intermediate the portions 8 and 9. When the chuck 6 assumes the first position of FIG. 1, as well as when it assumes the inverted second position of FIG. 2, the axis of the valving element 7 coincides with the axis 1 of rotation of the holder 2.

The portion 5 of the holder 2 contains a reciprocable piston 12 whose axis coincides with the axis 3 and which has an extension 17 receivable in a complementary socket of the chuck 6 to hold the latter against movement in the direction of the axis 1. The cylinder chamber at the upper axial end of the piston 12 (as viewed in FIG. 1) can receive pressurized liquid (normally oil) by way of a passage including a bore 13 in the portion 4 and additional bores 14, 16 in the portion 5. The bore 16 can communicate with a source (not shown) of pressurized fluid in a manner not forming part of the invention. A coil spring 15 is provided to withdraw the extension 17 from the socket of the chuck 4 when the pressure in the passage including the bores 13, 14 and 16 is relaxed. Instead of actually entering a socket of the chuck 6, the extension 17 can constitute a plunger which displaces a certain amount of hydraulic fluid in the chuck to thereby move one or several diaphragms 18 into reliable retaining engagement with the adjacent portion or portions of the stem 11. The diaphragm or diaphragms 18 are installed in an axial bore 20 of the chuck 6. The latter can cooperate with two discrete extensions 17, one for each of the two illustrated diaphragms 18.

When the chuck 6 is held in the first position of FIG. 1, the end portion or foot 8 of the valving element 7 is adjacent to a first circumferentially extending section or portion 21 of the working surface of a grinding wheel 19 whose working surface has a second circumferentially extending section or portion 22. adjacent to the portion 21. The axis of the grinding wheel 19 is inclined with reference to the axis 1 about which the valving element 7 rotates while the section 21 of the working surface of the rotating grinding wheel 19 removes material in the course of a first grinding operation, i.e., during removal of material from the end portion or foot 8.

Figure 4:
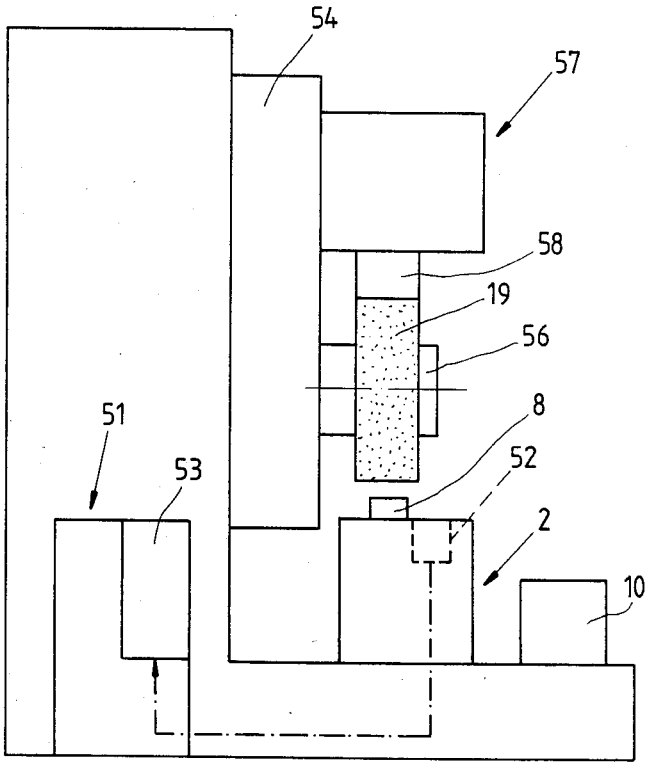
FIG. 4 is a diagrammatic view of the grinding machine which embodies the structure of FIGS. 1 and 3.

The treatment of the foot 8 involves removal of material from the valving element 7 until the dimensions of the treated foot match a preselected set of dimensions as determined by the control unit 51 of the grinding machine (see FIG. 4). The control unit 51 includes a conventional signal generating sensing or detecting device 52, which monitors the dimensions of the foot 8, and a memory 53 which stores signals denoting the dimensions of the treated foot 8 so that such signals can be used to control the removal of material from the head 9. Signals which are transmitted by the memory 53 are used to control the movements of a carriage 54 for the spindle 56 of the grinding wheel 19 when the section 22 of the working surface of the grinding wheel 19 is used to remove material from the head 9. Such removal of material can begin as soon as the chuck 6 and the valving element 7 therein are inverted with reference to the holder 2, i.e., as soon as the chuck is rotated or indexed about the axis 3 through 180 degrees so that the foot 8 and the head 9 of the valving element 7 exchange positions and the head 9 assumes the position which is shown in FIG. 2. The inverting means for turning or indexing the chuck 6 about the axis 3 includes the structure which is shown in the lower portion of FIG. 1 and in FIG. 3.

The motor 10 is arrested prior to start of the inverting operation. In the next step, a channel 24 in the portion 5 of the holder 2 is connected to the sump, not shown, so that it terminates the admission of pressurized hydraulic fluid into a chamber 26 adjacent to the radially outer end of a further piston 27 which is coaxial with the piston 12. At the same time, a further channel 29 in the portion 5 of the holder 2 admits a pressurized hydraulic fluid into a chamber 28 at the other axial end of the piston 27 so that the latter is attached to the portion 4 by a coupling device 31. Prior to engagement of the coupling device 31 (i.e., prior to termination of admission of pressurized fluid into the chamber 26), the portion 4 is free to turn relative to the piston 27. At the same time, the piston 27 disengages a Hirth-type serration 32 which normally operates between the portions 4 and 5.

The means for inverting or turning the chuck 6 with the valving element 7 therein, as well as with the portion 4 of the holder 2, includes a pinion 33 which is provided on the portion 4 and whose teeth mesh with the teeth of two parallel toothed racks 34, 36. Thus, the pinion 33 is disposed between the two racks and can be rotated thereby in a clockwise or in a counterclockwise direction, as viewed in FIG. 3. Portions of the racks 34, 36 constitute pistons 39, 42 and 41, 43 which are reciprocable in corresponding cylinder chambers 37, 38. The portion 4 is rotated in a clockwise direction, as viewed in FIG. 3, when the cylinder chambers 37, 38 receive pressurized hydraulic fluid which acts against the pistons 39, 41, and the portion 4 is rotated in the opposite direction if the pistons 42, 43 are acted upon by pressurized hydraulic fluid.

When the indexing of the portion 4 through 180 degrees is completed, the piston 27 is caused to reengage the Hirth-type serrations 32 so that the portion 4 is ready to rotate with the portion 5 of the work holder 2. The serrations 32 ensure that the portion 4 can be indexed between two predetermined angular positions, namely the first and second positions of FIGS. 1 and 2 in which the portions 8 and 9 of the valving element 7 in the chuck 6 are ready to be treated by the respective sections 21, 22 of one and the same grinding wheel 19.

FIG. 1 shows a sensor 44 which monitors the angular position of the portion 4 and chuck 6 relative to the portion 5. The exposed end portion of the sensor 44 assumes the phantom-line position of FIG. 1 when the portion 4 is indexed from the position of FIG. 1 to the position of FIG. 2.

The information which is stored in the memory 53 is used to ensure that the sealing portion 23 of the surface on the head 9 of the valving element 7 is located at a predetermined axial distance from the circumferential groove 20 and/or the end face 25 of the foot 8 of the treated workpiece.

FIG. 4 shows a dressing apparatus 57 whose dressing tool 58 (e.g., a wheel which is studded with industrial diamonds) treats the entire section 21, the entire section 22 but preferably the entire working surface of the grinding wheel 19 while the section 22 removes material from the head 9. The profile of the dressing tool 58 is complementary to the profile of the working surface on the grinding wheel 19.

When the grinding of the head 9 is completed, the piston 12 is retracted so that the chuck 6 releases the finished workpiece 7 and the latter can be expelled from the chuck (while the chuck is held in the position of FIG. 2) by a fluid-operated plunger 47 whose axis coincides with the axis 1. The plunger 47 can be caused to move axially in a direction to the right, as viewed in FIG. 1, in response to admission of pressurized fluid (e.g., compressed air) by way of a conduit or channel 46. A pneumatic cylinder and piston unit (not shown) or other suitable means can be used to introduce a fresh workpiece into the chuck 6 while the chuck continues to dwell in the position of FIG. 2 so that the foot 8 of the freshly inserted workpiece constitutes the leader and is ready to be ground after the chuck 6 is indexed through 180 degrees to reassume the position of FIG. 1.

The memory 53 can store information denoting the final dimensions of the freshly ground foot 8 and/or the corresponding position of the grinding wheel 19. The signals which are transmitted by the memory 53 during treatment of the head 9 are utilized to control the movements of the carriage 54 to thus ensure that the distance between the groove 20 and/or the end face 25 on the one hand and the central part of the sealing portion 23 of the surface on the head 9 on the other hand will match an optimum value which is necessary for proper operation of the valve which utilizes the valving element 7.

An advantage of the feature that the chuck 6 clamps the valving element 7 intermediate the head 9 and foot 8 is that each of the parts 8, 9 is fully accessible to the respective section 21, 22 of the working profile on the grinding wheel 19 in the corresponding position of the chuck 6, i.e., in the position of FIG. 1 or in the position of FIG. 2. Such accessibility is achieved without any axial shifting of the valving element 7 relative to and/or with the chuck 6.

It is presently preferred to grind first the foot 8 and to thereupon grind the head 9 of the valving element 7 which is held by the chuck 6. An advantage of dressing the entire working surface of the grinding wheel 19 while the section 22 of the working surface removes material from the head 9 is that this renders it possible to even more reliably adhere to the desired dimensions as regards the axial spacing of the groove 20 and/or end face 25 on the one hand and the portion 23 of the surface on the head 9 on the other hand. Moreover, this renders it possible to take advantage of the minimum acceptable thickness (axial length) of the grinding wheel 19 which must be adhered to for the sake of stability. The same applies for the dressing tool 58 which, as stated above, can constitute a diamond-studded wheel or roll.

An important advantage of the improved method and grinding machine is that there is no need to release the valving element 7 during any stage of treatment in the grinding machine, i.e., the stem 11 is grasped only once and its position relative to the chuck 6 remains unchanged until the last stage of treatment of the head 9 is completed so that the valving element is ready to be ejected from the chuck, not for the purpose of being clamped or otherwise held in a different way but rather to provide room for a fresh (untreated) workpiece. Such mode of manipulating the valving element greatly reduces the likelihood of appreciable deviation from optimum dimensions, especially as concerns the distance between portions of the foot 8 and portions of the head 9. Since the treatment of the head 9 is dependent on the dimensions of the finished foot 8 and on the position of the grinding wheel 19 after the grinding of the foot 8 is completed, the machine can accurately treat the portion 23 of the surface on the head 9 while simultaneously ensuring that the distance between such surface portion and the groove 20 and/or end face 25 of the foot 8 of the same valving element 7 will match or very closely approximate the desired distance.

Still another important advantage of the improved method and machine is that the machine can treat a large number of workpieces per unit of time. This is attributed to the absence of a need for repeated clamping of each workpiece. The interval which elapses between the instant of completion of treatment of the foot 8 and the start of treatment of the head 9 is a small fraction of the interval which is required in a conventional grinding machine wherein each workpiece must be released and reclamped upon completed treatment of the foot or head and prior to start of treatment of the head or foot. The units 51, 52, 53 are commercially available components which are manufactured, for example, by Marposs, Bologna, Italy.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of removing material from axially spaced-apart first and second portions of rotary workpieces which are symmetrical with reference to their axes of rotation, such as the reciprocatory elements of lift valves, comprising the steps of clamping a third portion of a workpiece; maintaining the thus clamped workpiece in a first predetermined position; grinding the first portion of the workpiece in such first position by a grinding tool; monitoring the dimensions of the ground first portion and generating and memorizing signals denoting the monitored dimensions; inverting the workpiece and maintaining the inverted workpiece in a second predetermined position without interrupting the clamping step; and grinding the second portion of the inverted workpiece by said grinding tool, including effecting a relative movement of the inverted workpiece and the the grinding tool as a function of the memorized signals.

2. The method of claim 1, wherein said inverting step includes turning the workpiece through 180 degrees about an axis which is normal to the axis of rotation of the workpiece.

3. The method of claim 1, wherein the third portion of the clamped workpiece is located between the first and second portions.

4. The method of claim 1 of removing material from poppets whose first portions constitute those ends of poppet stems which are remote from the heads and the second portions of which constitute the heads of the poppets, wherein said step of grinding the first portion of the workpiece in the first position includes removing material from the remote end of the poppet stem with said grinding tool while the axis of the grinding tool is askew to the axis of rotation of the poppet in said first position, said step of grinding the second portion of the inverted workpiece including removing material from the poppet head by said grinding tool.

5. The method of claim 1, further comprising the step of dressing the entire working surface of the grinding tool which removes material from the second portion of the workpiece in the course of the respective grinding step.

6. A machine for grinding axially spaced-apart first and second portions of rotary workpieces which are symmetrical with reference to their axes of rotation, such as the reciprocatory elements of lift valves, comprising a work holder; means for rotating said holder about a first axis; a chuck having means for clamping a third portion of a workpiece, said holder having means for supporting said chuck for angular movement about a second axis which is inclined with reference to said first axis; means for inverting the chuck and the workpiece in the chuck with reference to said holder, including means for turning said chuck about said second axis; a rotary spindle; and a grinding wheel on said spindle, said grinding wheel having a working surface including circumferentially extending first and second sections and said turning means including means for moving the chuck between a first position in which the first section of the working surface can remove material from the first portion of the workpiece which is held by said chuck and a second position in which the second section of the working surface can remove material from the second portion of the workpiece which is held by said chuck.

7. The machine of claim 6, wherein said second axis is normal to and intersects said first axis, said inverting means including means for turning said chuck through 180 degrees.

8. The machine of claim 7, wherein said clamping means includes means for engaging a third portion of a workpiece intermediate said first and second portions.

* * * * *